United States Patent [19]

Sands

[11] Patent Number: 4,519,611

[45] Date of Patent: May 28, 1985

[54] SLIDING RING GAME

[76] Inventor: Ned R. Sands, 2230 Holly Ave., Escondido, Calif. 92027

[21] Appl. No.: 542,141

[22] Filed: Oct. 14, 1983

[51] Int. Cl.[3] ..... A63F 3/00

[52] U.S. Cl. ..... 273/126 R; 273/127 B

[58] Field of Search ..... 273/126 R, 127 R, 127 B, 273/284

[56] References Cited

U.S. PATENT DOCUMENTS

| | | | |
|---|---|---|---|
| 416,463 | 12/1889 | Kochka | 273/126 R |
| 558,157 | 4/1896 | Chapman et al. | 273/126 R |
| 870,041 | 11/1907 | Lundberg | 273/126 R |
| 1,296,111 | 3/1919 | Olson | 273/126 R |
| 3,913,918 | 10/1975 | Trachtman | 273/126 R |
| 4,339,133 | 7/1982 | Warehime | 273/126 R |
| 4,364,568 | 12/1982 | Tracy | 273/284 |

FOREIGN PATENT DOCUMENTS

| | | | |
|---|---|---|---|
| 19143 | of 1912 | United Kingdom | 273/126 R |

*Primary Examiner*—Richard C. Pinkham
*Assistant Examiner*—T. Brown
*Attorney, Agent, or Firm*—Laurence R. Brown

[57] ABSTRACT

This game provides a set of rings for a corresponding number of players, a mallet for driving the rings on a course frictionally sliding across a smooth planar surface and a set of removable thin markers adherable to the playing surface to lay out a course of predetermined difficulty with a sequence of scoring stations. The scoring area defined by the markers can vary in size and difficulty as may the distance between the marker positions to thereby challenge players of various ages and skills. A particular challenge provided by this invention is that of design of the layout of a course of play by means of locating the removable markers to define a particular course layout before a match or meet.

1 Claim, 2 Drawing Figures

FIG. 1.
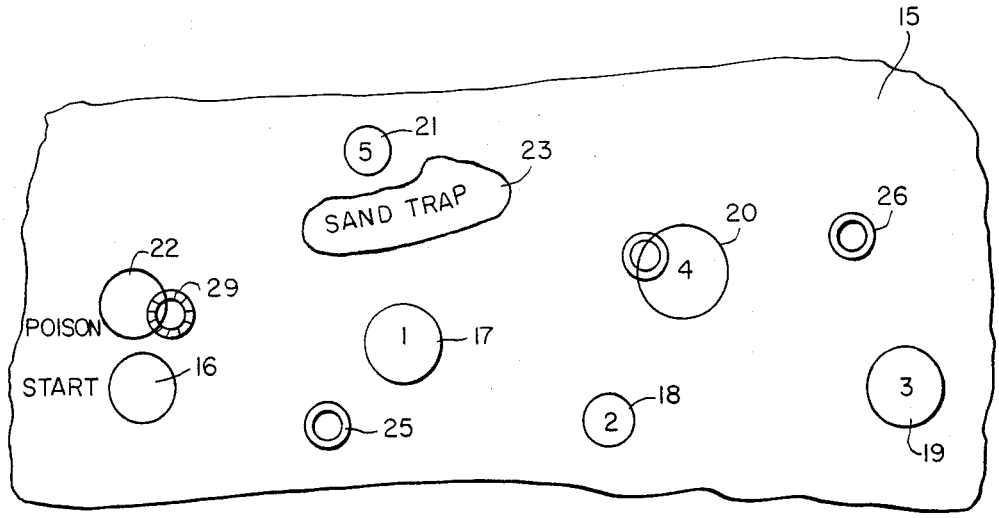
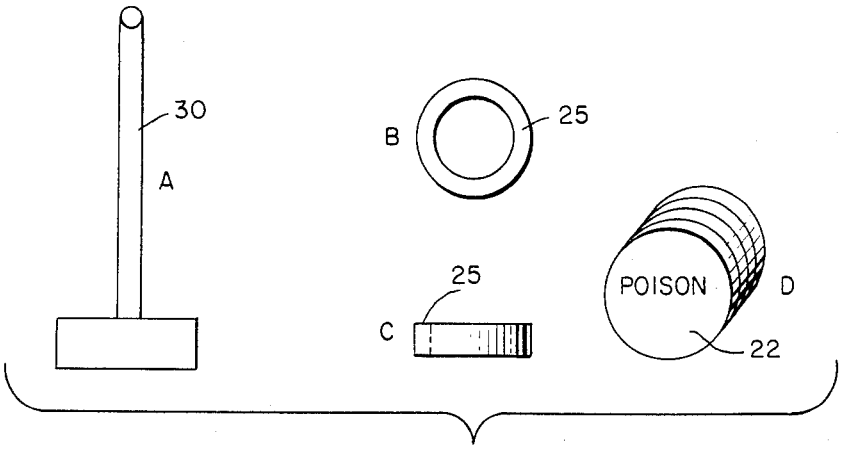
FIG. 2.

SLIDING RING GAME

TECHNICAL FIELD

This invention relates to toys and more particularly it relates to games played on a game course by projecting a ring frictionally in contact with a smooth planar surface wherein the game course may be laid out by the participating players.

BACKGROUND OF THE INVENTION

Various well known competitive games such as croquet, hockey, golf and shuffleboard, use impact type play pieces advanced by a club over a field of play. The play pieces are in general balls or discs. Disc type hockey games are described in U.S. Pat. No. 3,913,918—Oct. 21, 1975 to A. Trachtman and U.S. Pat. No. 4,339,133—July 13, 1982 to N. R. Warehime.

Deficiencies of the prior art games of this type include the high cost of special rink equipment, the lack of adaptability to players of different ages and skills and the versatility to conform with various player interests, educational needs and recreational desires. For example, some games have limitations of the number of players, team play and field of play specified as on a particular board or rink. Others after acquisition of some skills are discarded because they no longer present a challenge. Most are so unvariable that they cannot conform to the local play environment, the mood of the players and various skills of players. In particular most games of this class are played on invariable course layouts that are not either adaptable to the interests and skills of the participating players nor the available course sites which may vary in size, shape and characteristics.

This invention therefore has as a general objective the general resolution of the aforesaid prior art deficiencies.

Other objects, features and advantages of the invention will be found throughout the following description, the drawings and the claims.

DISCLOSURE OF THE INVENTION

The game can be played on any artificial or natural smooth planar surface, such as cement, ice, wood, plastic, etc. Thus, it can be played outdoors, indoors, or on a special gameboard surface which provides a sliding surface for the game pieces formed as rings with a frictional sliding surface and projected by a manually wielded club or mallet across the surface in a direction and at a distance dependent upon the skill and coordination of the player. The ring provides less friction and weight than a disc, and forms a visible guage showing whether it is at any of the succession of geometrically shaped scoring position markers removably positioned to lay out a field of play. Thus, a sequence of circles may be chalked on a cement patio surface to outline an individually designed course, where the circle border cannot show in the ring projected onto the circle for scoring or advancing. Alternatively adhesive indicia in the form of thin paper or plastic markers may be used.

The game is adapted to different skill levels by variably selecting the size of the scoring area at different markers such as by circles of different size, or rings of different size. Versatility can be provided by marker obstacles such as sand traps if a golf game and golf course is simulated, goals if hockey or croquet is to be simulated, point scoring markers if shuffleboard is to be simulated, etc. Special games such as "poison", hereinafter described, are also afforded.

It is important in view of the friction sliding nature of a ring in this invention that it be tall enough to extend from the surface as a good target for a mallet or club. Also, it is desirable to have a "live" game piece that can go far and fast with a mallet stroke to provide better training of coordination skills. Thus, the ring shape is pertinent in keeping down weight and friction and serves further in the scoring and versatility of the game.

BRIEF DESCRIPTION OF THE DRAWINGS

In the drawing:

FIG. 1 is a plan view of a fragment of a smooth planar surface field of play with typical markers and game pieces thereon representing a game in progress with four players; and FIGS. 2A, 2B, 2C and 2D are views of the basic game elements for coordinated use on a existing playing surface to lay out a field of play and playing the game thereon.

THE PREFERRED EMBODIMENT

As may be seen from FIG. 1, a fragment of a smooth planar playing surface 15 typically ice, wood, cement, tile, etc. is sketched upon which is layed out a playing course on a field of play. This particular course layout is made to illustrate versatility of the game and varous features. Adhered to this surface is a set of thin removable scoring or advancing markers 16 to 22 and a thin removable obstacle marker 23. These can be simply crayon or chalk markings on a patio or recreation rooom surface, or thin self-adhering paper of plastic film markers that do not substantially interfere with the projected course of a sliding game piece 25, 26 or 27, etc. The markers 16 to 23 can be identified as desired to show the sequentially pursued scoring areas 1, 2, 3, 4 and 5 as well as a starting area 16 and a final sequential area 22.

Note that to provide handicaps and to vary skill requirements either the markers (compare 20 and 21) or the game piece rings (compare 25 and 26) may be varied in size. Thus, if the game rule provides that the scoring area must lie wholly visibly within the ring without seeing a border line or the marker (as shown on marker 20), it is seen that it is easier to project a game piece onto a larger scoring area such as marker 20 than onto the smaller scoring area of marker 21. Similarly, a larger ring 26 may be harder to place in the scoring area of a smaller marker 21. The markers and scoring areas need not be coexistent or circular in shape but can have different geometric configurations. Circular shapes are preferable, simple and convenient.

For game selection, special makers, such as sand traps 23 may be used to provide variations such as special simulation of a golf game. Thus, this invention contemplates golf course design and course layout design as one of its features to provide versatility, interest and challenge to the players. The markers may be simply removed and replaced or redrawn. In like manner hockey goals, shuffleboard type scoring areas, etc. may be provided as well as special markers for a particular game, such as the "poison" marker 22 and associated "poison" ring 27 (striped). This latter ring 27 may be striped on one side and turned over when the course is completed. Different players may have different colored rings.

As shown in FIG. 2, the basic elements of the sliding disc game afforded by this invention are: (FIG. 2A) a manually actuated mallet 30, (FIG. 2B plan view, FIG. 2C elevation view) a ring 25 with friction slide characteristics thick enough to be struck by the mallet 30 when resting on the surface and elastic enough to be projected in a direction over a distance depending upon the coordination and skill of the manual operator, and a set of replaceable markers 22, etc., such as removable paper or plastic film sheets adhesively adhering to the playing surface.

For a full sized playing court, typically the markers are circles nine inches (23 cm) in diameter, spaced ten feet (3.05M) apart center to center. The rings typically are made of a resilient hard plastic with inside diameter of four inches (10 cm) and outside diameter of four and one-half inches (11.5 cm). The mallet has a handle length of twenty-six inches (66 cm), a handle diameter of $\frac{7}{8}$ inches (2.22 cm) and a mallet body ten inches (25.4 cm) long and two inches (5 cm) in diameter.

A preferred game to be played may be called ∓Poison". No rink or playing field boundary is necessary and the only course obstacles are the rings of the players in place somewhere on the field of play. Each player has his own ring, preferably of a particular color, and the players take turns with a mallet on the playing field in an order determined by lottery. It is advantageous to start last.

The game objective is to run the course scoring at all sequential markers by placing the ring in scoring position, reaching an end marker "poison" and eliminating all other rings by striking them by a mallet stroke projection in turn by a player when his ring is "poisoned". (The start and poison marker may be the same, if desired.)

The size, shape and playing field course is selected by the players according to skill or difficulty desired, and handicaps may be given such as larger or smaller puck sizes. Any number of players more than two can participate in individual or team competition.

Each player in turn is given one shot or more to score by placing the ring on the first marker (17). The color or rim of the circle must be covered by the entire ring or the interior space as predetermined to score, and advance to the next sequential marker (18). Scoring on a marker adds a further shot. A perfect "score" would be to sequence all the markers and become "poison" on a single turn. Whenever a circle is missed, the next player has a turn. Also a shot is given for striking another ring the first time (not twice in a row for the same ring without an intervening shot). Rings are left in place where they end up without earning another shot until the player's next turn.

When a player becomes "poison" another shot is not earned and he must await the next turn. Then each ring hit by the "poison" ring from a mallet projection is eliminated from the game. The poison circle 22 is a "safety" haven. Another "poison" ring cannot eliminate a player when in the poison circle awaiting the next turn. The single surviving "poison" ring is the winner in individual competition, or if team play uses special colors, the team that eliminates all other team rings is the winner.

It is seen therefore that a versatile, interesting game is provided that permits design of a game course and adapts to a wide range of skills and player preferences as well as different surface sites and game simulations. Thus, the removably positionable game markers provided by this invention serve to uniquely adapt the game to the challenges of design of a championship type golf course, or the like, upon which a competitive meet may be held. Thus, each meet may be preceded by the previous winner's (or a player chosen by lot) arrangement of the course markers to present his preferred or novel course layout. This develops a new set of coordinated skills, mental and physical challenges to the participating players not routinely found in corresponding games of the prior art. Thus, the state of the art has been advanced. Accordingly, those novel features believed descriptive of the nature and the scope of the invention are defined with particularity in the claims.

I claim:

1. A game set for playing on a flat planar playing field surface, comprising in combination, a set of rings each defining a central see-through aperture and carrying indicia differentiating certain of said rings from other rings and signifying individual movable playing members and presenting a surface for sliding over said planar surface in a direction and length dependent upon a player's skill when the ring is impacted by a blow delivered by a player parallel to the surface, at least one mallet constructed to strike said blow when manually swung by a player's arm, and a set of removable thin markers having indicia thereon designating a course sequence from marker to marker and each marker designating a scoring area of a size at least that of the ring aperture for visual exposure thereby when the rings are positioned thereover, said markers being constructed for removably adhering to the playing field surface in a plurality of positions designating a playing course and having a surface structure permitting the rings to slide thereover when in place on said surface without substantial interference for positioning at will on said surface in response to mallet strikes with the marker positions defining a plurality of scoring stations for dispersal throughout the playing course over which the rings are played by sequentially striking the rings toward scoring areas defined by the individual markers and made visible within the ring aperture when positioned in the scoring zone on the markers positioned on the surface, and the areas of said geometric markers in the set include different markers with smaller and larger scoring areas thereon making it more and less difficult to place a ring in some scoring areas.

* * * * *